United States Patent [19]

Johansson

[11] 3,950,063

[45] Apr. 13, 1976

[54] CONNECTOR FOR LOOPED WIRE

[75] Inventor: Ronald C. Johansson, Croix Beach, Minn.

[73] Assignee: Minnesota Mining and Manufacturing Company, St. Paul, Minn.

[22] Filed: Oct. 21, 1974

[21] Appl. No.: 516,607

[52] U.S. Cl. ..... 339/97 R
[51] Int. Cl.[2] ..... H01R 11/20
[58] Field of Search ..... 339/95, 97–99

[56] References Cited

UNITED STATES PATENTS

| | | | |
|---|---|---|---|
| 3,500,292 | 3/1970 | Enright et al. | 339/97 R |
| 3,609,644 | 9/1971 | Seim | 339/98 |
| 3,718,888 | 2/1973 | Pasternak | 339/98 |
| 3,836,944 | 9/1974 | Lawson | 339/99 R |

*Primary Examiner*—Joseph H. McGlynn
*Attorney, Agent, or Firm*—Alexander, Sell, Steldt & DeLaHunt

[57] ABSTRACT

A connector for tapping a run wire at a loop therein has a grooved snubbing post disposed centrally of a loopreceiving channel, and a bifurcate spring compression reserve contact member fitting within the groove in the post and across the channel.

5 Claims, 19 Drawing Figures

CONNECTOR FOR LOOPED WIRE

Figures 1, 2, 3, 4, 4A, 5, 6A, 6B, 16:
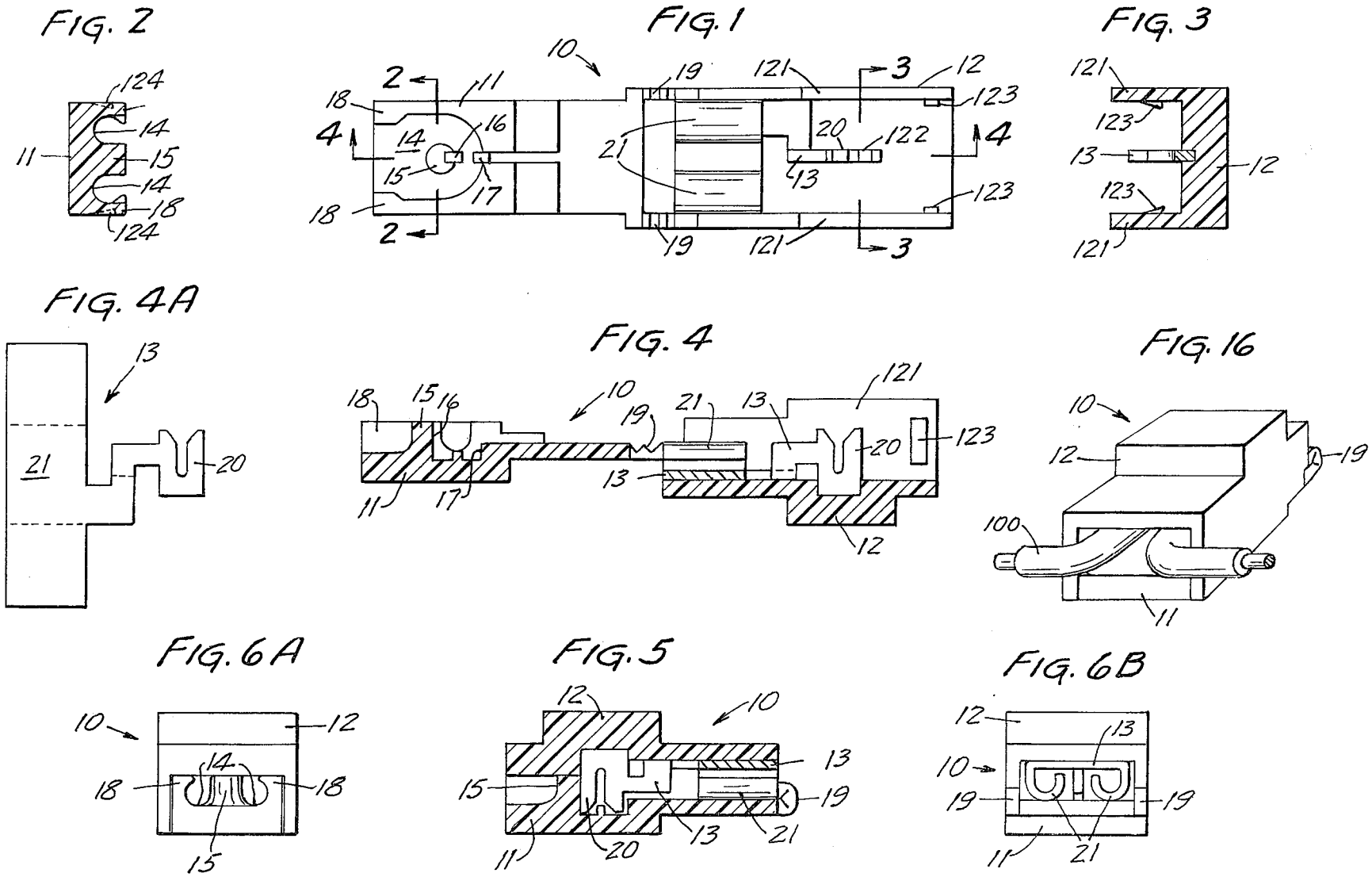

This invention relates to solderless wire-connectors or wire-taps useful in making tap or T connections to insulated wires.

Spring compression reserve contact elements and connectors suitable for making tap connections to insulated wires have been described, for example in U.S. Pat. No. 3,500,292. The connectors of the present invention provide additional advantages, particularly in the form of improved strain relief.

The wire to which connection is desired is formed into a loop within a loop-receiving channel and about a loopretaining or snubbing post, and spring compression reserve electrical contact is made between the looped wire and a bifurcate plate contact element. The element is supported and reinforced by said post. The loop of wire is retained within the channel and snubbed against the post, so that the effectiveness of the connection is maintained under conditions of considerable tension and vibration.

In one preferred form of the connector, the grooved post is located on the channeled body at the center of the channel. The groove faces the closed curved end of the channel and is extended segmentally across the adjacent bottom of the channel. The contact element is retained in a cover which preferably forms an extension of the body and is hinged so that, when the cover is folded over the body, the element is directed into the grooves and over a wire supported in the channel. Alternatively, a separate cover may be provided, with extended side walls or other means for insuring proper placement when applied to the body.

The wire to which connection is to be made is formed into a loop which is placed within the channel and around the post of the body. The cover is then closed, thereby forcing the contact element into the grooves in post and channel bottom, into the wire insulation, and over and in electrical contact with the conductor. The post prevents the wire loop from being slid out of the channel. The walls of the channel prevent straightening of the wire at the loop. The cover prevents lifting of the wire from the channel. Thus, the loop is effectively immobilized within the close-fitting channel and fully effective contact is maintained.

The opposing end of the contact elements may assume any desired shape. It may, for example, be a cylindrical receptacle, as in the connector of U.S. Pat. No. 3,500,292, or a spade or other male type of contact. It may be initially accessible, as in a connector having separate body and cover components. Alternatively the contact may become accessible only upon application of the connector to the wire, e.g., upon folding of the one-piece body and cover member.

Lifting of the wire from the channel may be prevented by supplying a permanent cover over the open end of the channel, in which case the post may be given an inclined face on the side toward the opening. The looped wire is then inserted through the open end and slides up and over the post where it is connected and secured as before.

In another alternative structure the grooved post extends from the cover rather than from the body and the contact element is permanently positioned in the groove. Upon lowering the cover over the channeled body containing the loop of wire, the post passes into the loop area while the bifurcate contact is being forced into the wire-insulation and onto the conductor as before. Pit-like slots in the floor of the channel receive the pointed tips of the element and assure full contact with the conductor.

Figures 7, 8, 9, 10, 11, 11A, 12, 13, 14, 15:
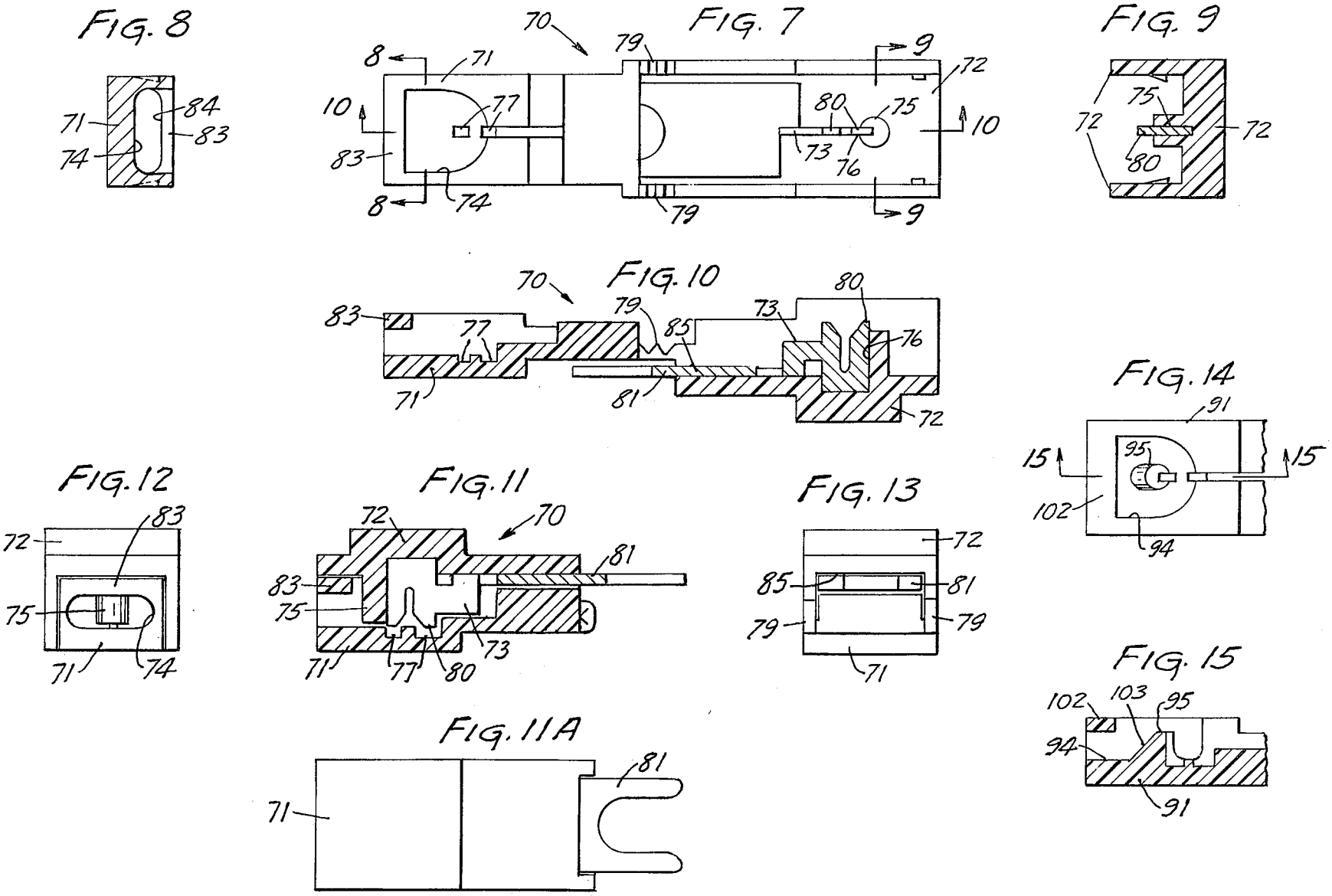

Other modifications, combinations and variations will be pointed out or will occur to the knowledgeable reader upon consideration of the following description and the appended drawing, wherein FIG. 1 is a top plan view, and FIGS. 2–4 are sectional views taken approximately as indicated thereon, of one form of connector in open position, FIG. 4A is a plan view of a blank from which the contact element of FIG. 4 is formed, FIG. 5 shows the connector in closed position and sectioned as in FIG. 4, and FIGS. 6A and 6B are respectively left and right end elevations of the closed connector, FIG. 7 is a top plan view of an alternative form of connector, FIGS. 8, 9 and 10 are sectional views taken approximately as indicated in FIG. 7, FIG. 11 is a longitudinal sectional elevation as for FIG. 10 of the connector of FIG. 7 in closed position, FIG. 11A is a bottom plan view, and FIGS. 12 and 13 are left and right end elevations respectively of the closed connector, FIGS. 14 and 15 are partial top plan view and longitudinal sectional elevation respectively of the wire-channel portion of another form of connector body, and FIG. 16 is a view in perspective of the connector of FIG. 1 as applied to a wire.

The connector 10 of FIG. 1 comprises a body 11, attached cover 12, and contact element 13. The body has a partially walled U-shaped wire-receiving channel 14 and a central post 15. The post and the floor of the channel are grooved at grooves 16, 17. The walls 18 are inwardly tapered or curved, as most clearly shown in FIGS. 2 and 6A, to assist in preventing a wire loop, once inserted in the channel, from being lifted therefrom prior to closing the connector.

The body 11 and cover 12 are connected together by narrow edge hinges 19. The cover has side walls 121 and a central groove 122 into which is fitted a portion of contact element 13. The element has a bifurcate end 20 extending from the said groove in the inner surface of the cover and another end 21, in this instance shown as a receptacle or female contact, supported adjacent the open area between the hinges 19. The element is formed from a blank as illustrated in FIG. 4A, by folding as indicated by dotted lines and to the shape shown in FIGS. 4 and 6B.

Closing the connector by folding at the hinges 19 into the position shown in FIG. 5 will be seen to expose the free end 21 of the element 13 and make it accessible for contact with a cooperating contact element, for example a male quick-slide contact, as will be apparent from FIG. 6B.

The connector as applied onto a loop of insulated wire 100 is illustrated in FIG. 16. Top and bottom are held firmly together by catches 123 fitting into cooperating openings 124 as best seen in FIGS. 3 and 2 respectively.

The connector 70 of FIGS. 7–13 similarly has a body 71 and cover 72 connected together at hinges 79, and a contact element 73. In this modification the grooved post 75 extends from the cover rather than from the base, and the one leg of the bifurcate contact 80 is permanently positioned in the groove 76. The U-shaped channel area 74 of the body is covered at the open end with a top 83, defining an elongate oval opening 84 into which the loop of wire is to be slid. Grooves 77 in the floor of the channel are positioned to receive the tips of the contact 80 when the body and cover are folded together, at which time the post 75 contacts or closely approaches the center of the floor as shown in FIG. 11. The other end of the contact element 73 in this instance is shown as a flat spade contact 81 and extends through an opening 85 in the cover 72.

FIGS. 14 and 15 illustrate a modification with a body 91 having a U-shaped wire-receiving channel 94 covered at the open end with a top 102 as in FIG. 7 and also containing a grooved post 95. In this instance the side of the post facing the open end of the channel is sloped, the slope 103 permitting a looped wire-end to be slid beneath the top 102 and over and around the post 95 into position for making electrical contact upon closing of the connector.

What is claimed is as follows:

1. A wire-connector for snubbing and electrically contacting a loop of insulated wire, comprising: a body having a U-shaped channel for receiving and supporting a loop of wire, a post at a position corresponding to the center of the U defined by said channel and extending perpendicular to the plane of said U, and a contact element having a bifurcate spring compression reserve contact end and another contact end; and wherein said post is grooved along the side adjacent said loop to form a retaining groove for said bifurcate contact, and the floor of said channel is grooved in line with the groove in said post to provide grooves for receiving the tips of said bifurcate contact.

2. Wire-connector of claim 1 wherein said channel is formed in a body portion and said post forms a part of a cover portion, and said contact element is retained in said cover portion.

3. Wire-connector of claim 1 wherein said channel and said post are formed in a body portion and said contact element is retained in a cover portion associated therewith.

4. Wire-connector of claim 3 wherein said body and said cover are hingedly interconnected.

5. Wire-connector of claim 3 including in said body portion a top member covering the open end of said channel and wherein the side of said post facing said open end is sloped upwardly away from said open end.

* * * * *